United States Patent [19]

Perch et al.

[11] 4,225,391

[45] Sep. 30, 1980

[54] METHOD OF PREPARING COALS FOR COKING

[75] Inventors: Michael Perch; Alex Peterson, Jr., both of Pittsburgh, Pa.

[73] Assignee: Koppers Company, Inc., Pittsburgh, Pa.

[21] Appl. No.: 929,491

[22] Filed: Jul. 31, 1978

[51] Int. Cl.[3] ..... C10B 53/08

[52] U.S. Cl. ..... 201/6; 201/9; 201/21; 201/23; 201/24; 201/40; 201/42

[58] Field of Search ..... 201/6, 20, 21, 23, 24, 201/40, 5, 42, 8, 9, 41; 264/29.1, 29.3; 44/1 R, 10 R, 10 C, 10 J, 10 K

[56] References Cited

U.S. PATENT DOCUMENTS

| | | | |
|---|---|---|---|
| 1,030,333 | 6/1912 | Rusby et al. | 201/24 X |
| 1,593,208 | 7/1926 | Culmer | 201/21 |
| 2,752,293 | 6/1956 | Burstlein | 201/8 |
| 2,885,327 | 5/1959 | Yavorsky | 201/40 X |
| 3,546,076 | 12/1970 | Muller et al. | 201/9 X |
| 3,878,052 | 4/1975 | Hayashi et al. | 201/21 X |
| 3,966,561 | 6/1976 | Hinkley | 201/6 X |
| 4,100,031 | 7/1978 | Kiritani et al. | 201/24 X |
| 4,142,941 | 3/1979 | Weber et al. | 201/6 |
| 4,178,215 | 12/1979 | Kiritani et al. | 201/23 X |
| 4,186,054 | 1/1980 | Brayton et al. | 201/6 |

FOREIGN PATENT DOCUMENTS

| | | | |
|---|---|---|---|
| 7700179 | 8/1977 | Netherlands | 201/24 |

*Primary Examiner*—Frank W. Lutter
*Assistant Examiner*—Roger F. Phillips
*Attorney, Agent, or Firm*—R. Lawrence Sahr

[57] ABSTRACT

A method of preparing coals for coking in a conventional coke oven includes agglomerating the loose coal, in combination with a binder, into flakes, mixing the flakes with non-agglomerated coal, and charging the mixture into the coke oven in the conventional manner. The method provides for the utilization in a conventional coke oven, of coals that are marginal in coking quality, greater bulk densities of the coal as charged into a conventional coke oven, acceptable shatter resistance and physical stability of the coke produced, and acceptable carbonization pressure on the coke oven walls.

10 Claims, No Drawings

METHOD OF PREPARING COALS FOR COKING

BACKGROUND OF THE INVENTION

1. Field of the Invention

The invention relates to the coking of coal, more specifically, to the preparation and use of coals of marginal coking quality in commercial coking facilities.

2. Description of the Prior Art

Suitable quality low, medium and high-volatile content bituminous coal are beginning to be in short supply and/or are too expensive to be used in the production of metallurgical-grade coke. Partial or total replacement of the premium-grade coals with less expensive, generally lower quality coals, usually results in coal blends that are marginal in coking quality and in coke that is lower in physical stability than that normally produced. It has been shown by those skilled in the art that partial agglomeration of marginal quality coking coal blends yields coke that is higher in physical stability than coke that is produced from the same coal blends, but without agglomerates. It is therefore possible, in some cases, to use partially-agglomerated, marginal quality coal blends in conventionally-charged coke ovens without severe sacrifices in the quality of the coke produced. The agglomerates used are typically similar in shape and size to the charcoal briquettes that are available for home recreational consumption. These briquettes are compressed from loose coal that is mixed with a binder. Many binders have been effectively used, including plain water, light oil, pitch and coal tar. The most effective of these binders has proved to be coal tar. However, coal tar is a valuable substance, being the basis for many modern useful chemicals. The economics of the utilization of coal tar dictates that it is too expensive to utilize to any great degree as a binder for coal agglomeration.

The solution to the economic problems associated with the use of coal tar binder has been largely overcome by the development of coal-tar-based solutions and suspensions which greatly reduce the percentage of coal tar required to bond the coal in the briquetting process. The physical integrity of the briquettes may be further enhanced by preheating the coal fines prior to briquetting. The result is an economically feasible briquette with good structural qualities.

Unfortunately, a serious problem does occur with some coal blends that are charged into the coke oven as a mixture of briquettes and non-agglomerated coal. Carbonization pressures on the walls of the coke oven are greatly increased. As is well known to those skilled in the art, carbonization pressures beyond certain limits produce a high degree of probability that the coke oven will be overstressed, causing rapid deterioration of the refractory therein and a shortening of the expected production life thereof. For this reason most untried coals or blends of coals are tested to determine carbonization pressure. Only those which display carbonization pressures within acceptable limits are used in conventional coke oven.

Tests were run on several commercially accepted blends of low to medium-volatile content coal mixed with high-volatile content coal, both with and without the addition of briquettes. The briquettes used in these tests were pillow-shaped with an average size of 1.8"×1.3"×0.8". Additional information concerning these briquettes is shown in Table I.

Table I

| Blend No. | Composition | Briquette Data: Moisture Content % | Tar Binder % | Apparent Density, lbs/cu.ft. | Bulk Density, lbs per cu ft |
|---|---|---|---|---|---|
| 1 | 85% Pittsburgh Seam 15% Beckley Seam | 2.5 | 4.0 | 76.0 | 42.0 |
| 2 | 85% Elkhorn Seam 15% Beckley Seam | 1.8 | 4.1 | 70.2 | 40.9 |
| 3 | 85% Illinois No. 6 Seam 15% Pocahontas No. 3 Seam | 4.7 | 3.8 | 72.6 | 43.5 |

The apparent density was determined by measuring the volume of water displaced by a briquette of known weight. The bulk density was determined by measuring the weight of briquettes contained in a cubic-foot box.

Table II shows three typical coal blends used in conventional coking operations, their carbonization pressures without briquettes, with 20% briquettes, and with 40% briquettes by weight. The carbonization pressures shown in Table II are maximum wall pressures in pounds per square inch as measured using a Koppers Company, Inc. movable wall test oven and the standard procedures applicable thereto, both of which are well known to those skilled in the art.

Table II

| Blend No. | Composition | Carbonization Pressures of Coal Blends: Briquetts % by wt. | Bulk Density lbs per cu ft | Maximum Wall Pressure psi |
|---|---|---|---|---|
| 1 | 85% Pittsburgh Seam 15% Beckley Seam | 0 | 53.5 | 1.21 |
| | | 20 | 57.5 | 1.77 |
| | | 40 | 57.9 | 2.43 |
| 2 | 85% Elkhorn Seam 15% Beckley Seam | 0 | 53.2 | 1.68 |
| | | 20 | 57.0 | 2.15 |
| | | 40 | 57.0 | 2.55 |
| 3 | 85% Illinois No. 6 Seam 15% Pocahontas No. 3 Seam | 0 | 52.1 | 1.71 |
| | | 20 | 57.1 | 2.14 |
| | | 40 | 59.1 | 2.53 |

It was determined in the three coal blends tested, as shown in Table II, that without briquettes, the carbonization pressures were somewhat lower than those same blends exhibited when containing briquettes. When the mixtures contained 20% briquettes, the carbonization pressures increased 25–50%; and when the mixtures contained 40% briquettes, the carbonization pressures increased 50–100%. Thus the problem is crystallized: How is it possible to utilize partially-agglomerated coal blends of marginal coking quality coals that will yield coke of the highest possible physical stability and yet still not develop coke oven wall pressures beyond the limits that are detrimental to the productive life of the coke oven?

The results shown in Table II are exemplifications of many tests familiar to those skilled in the art. One of the parameters that appears from the many tests is that the lower the average volatile content of the coal blend, the higher the oven wall pressure. The average volatile content of the coal blend can be raised either by reducing the percentage of low to medium volatile coal in the blend or by including, into the blend, grades of coal more in the range of medium-volatile content, as distinguished from those in the range of low volatile content. Blends have been tested and found to be within the range of acceptable oven wall pressure, which range from 40% low and/or medium volatile coal blended with 60% high volatile coal to about 10% low and/or medium volatile coal blended with 90% high volatile coal. Many of these blends have been tested as including varying percentages of compacted coal fines, represented by briquettes, as well as without agglomerates. A correlation has developed to the extent that a second parameter can be stated. In such blends, the higher the percentage of briquette inclusions,

SUMMARY OF THE INVENTION

Compaction agglomeration, an example of which is briquetting, has long been known as a method of composing finely divided solids into larger units. In dealing with finely-crushed coal of the size consistently used in commercial coke ovens, the desired forms of compaction agglomeration is considered a matter of design choice, including considerations of availability and cost of equipment and the physical size of the end material desired.

Recently, experiments were conducted to evaluate other forms of compaction agglomeration in an effort to eliminate some of the handicaps associated with briquette formation and utilization. The primary objective of this investigation was to reduce agglomerate segregation that occurs when partially-agglomerated coal blends are charged to a coke oven. To achieve this objective flaking was considered as an alternate method of compacting coal. Tests were made to determine the difference, if any, between the use of briquettes and flakes in similar partially-agglomerated coal blends of marginal coking quality. A totally unexpected test result was observed during these test. Where the briquettes were replaced by flakes in the same ratio of agglomerated to non-agglomerated coal, the oven wall pressure did not increase as expected. In one test the oven wall pressure decreased where flakes were added to the unagglomerated coal blend. In another, the oven wall pressure remained nearly the same as found when only non-agglomerated coal of the same blend was used. Thus, the invention may be postulated: To achieve acceptable oven wall pressures when utilizing partially-agglomerated coal blends of marginal quality in commercial coke ovens, combine flakes of such a coal blend with unagglomerated coal, also of such a coal blend, in an amount of up to 50% by weight.

DETAILED DESCRIPTION OF THE PREFERRED EMBODIMENT

In the preferred embodiment a blend of 85% Illinois No. 6 Seam and 15% Pocahontas No. 3 Seam coal is utilized, the percentage composition being measured by weight. Illinois No. 6 Seam coal is considered a high volatile coal, having a volatile matter content of about 36–38%. Pocahontas No. 3 Seam coal is considered a low to medium volatile coal, having a volatile matter content of about 22–24%. The volatile range classifications for coal are found in "Chemistry of Coal Utilization", Vol. I, page 58, 1945 edition, as published by John Wiley & Sons, N.Y. N.Y., which is a well-known reference in the field of the art. Those ranges are as follows:

Table III

| Volatile Range Classifications of Coal | |
|---|---|
| Low Volatile Coal | 14–22% volatile matter mineral-matter free dry basis |
| Medium Volatile Coal | 22–31% volatile matter, mineral-matter free dry basis |
| High Volatile Coal | 31% or more volatile matter, mineral-matter free dry basis |

The unagglomerated coal of this blend used for coking was of a well-known and commonly used size, being in the range of 0 to 6% on a ¼" screen, 10 to 24% on a ¼"×6 mesh screen, and 70 to 90% passing through a 6 mesh screen. Other sizes can be alternately used, the limitation being that the size be generally acceptable for the production of flakes and good quality coke. These size ranges are well known to those skilled in the art. The preferred blend is utilized having a typical screen analysis as follows:

Table IV

| Coal Blend Screen Analysis | | |
|---|---|---|
| Percentage on: | ¼" screen | 0.4 |
| | ¼" × 4 mesh screen | 2.1 |
| | 4 × 6 mesh screen | 7.9 |
| | 6 × 8 mesh | 13.9 |
| | 8 × 16 mesh | 26.2 |
| | 16 × 30 mesh | 22.8 |
| | 30 × 50 mesh | 7.9 |
| | 50 × 100 mesh | 7.4 |
| | 100 × 200 mesh | 0.3 |
| | 200 × 325 mesh | 3.4 |
| | through 325 mesh | 7.7 |
| | Total | 100.0 |

This finely-crushed, unagglomerated coal blend normally has an as-received moisture content range of about 9.0 to 13.0%. In the preferred blend, the as-received moisture content is about 12.1%.

The different types of non-agglomerated coals are blended in the desired ratio. As previously mentioned, in the preferred embodiment, 85% Illinois No. 6 Seam coal is blended with 15% Pocahontas No. 3 Seam coal, by weight. The blending of the coals may be accomplished by any one of many dry bulk blending methods which are well known to those skilled in the art. Essentially, the blending step consists of two proportional additions of one type of coal to another, coupled with a mechanical agitation to mix two types to an homogeneous blend.

To agglomerate the finely-crushed coal blend, a binder must be prepared for the coal fines. Most types of known coal-tar based binders of the type used in briquetting are adequate. In the preferred embodiment, a binder is prepared, typically, with the following composition:

Table V

| Tar-Emulsion Binder Composition (by weight) |
|---|
| 42% Water (tap or equivalent quality) |
| 12% Ammonium Lignosulfonate (5% Aqueous Solution) |
| 12% Polyvinyl Alcohol (5% Aqueous Solution) |
| 34% Coal Tar |

The water is agitated and heated to 150°-180° F. Then the aqueous solutions of ammonium lignosulfonate and polyvinyl alcohol are added. The coal tar is heated to 150°-180° F. and added to the previous mixture. Finally, the result is agitated until visibly emulsified.

The blended loose coals are then charged into a mixing apparatus, agitated, and heated therein to 150°-180° F. by the in-direct applications of steam at about 20 psig. It is important, in the preferred embodiment, to insure that the hot coal blend is prevented at this point from drying below its normal air-dry moisture content.

Once the coal blend has been heated to 150°-180° F., the blend continues to be agitated. During this agitation, the tar emulsion, at 150°-180° F., is sprayed onto the hot moist coal blend at a rate of approximately 0.5 gallon per minute per spray nozzle until about one pound of tar emulsion for each nine pounds of coal has been sprayed onto the coal fine blend. Then the tar-emulsion spray is halted, but the agitation continues for about 15 minutes to ensure that all of the coal in the blend is thoroughly wetted with coal tar emulsion. Following this final agitation, the loose coal-binder mixture is dryed to the point where the moisture content is reduced to a range of about 8 to 12%. In the preferred embodiment, the moisture content is about 10%. The range of actual coal tar in the mixture is about 3.6% to 4.4% by weight, dry basis.

The final phase of preparation of flakes is the agglomeration or compacting phase. In the preferred embodiment, a commercially available roll press is used. The roll press is preferably equipped with two 40-inch (1000 mm) compaction rolls which are driven at 9 rpm. The compacting pressure developed is about 10 tons per lineal inch of roll width. The surfaces of the compacting roll working faces are smooth. Currently, the 40-inch diameter roll is about the largest size used in commercial production facilites. To effect higher production rates, longer rolls would be required.

The blended loose coal-binder mixture is gravity fed to the roll press at ambient temperature. It is possible to gain a modest improvement in flake quality by preheating the mixture. However, in the blend utilized in the preferred embodiment, there is no significant advantage gained. The roll press produces a continous compacted ribbon which breaks into various sized pieces, flakes, during subsequent material handling.

The flakes produced by the process of the preferred embodiment range from ½ to 4 inches in length by ½ to 4 inches in width by 1/16 to ½ inch in thickness. The apparent density of these flakes range from 70 to 75 lbs. per cubic foot. There is a small amount of residue that is formed, being smaller pieces of compacted mixture. This residue is collected and fed back through the press with no detrimental effects.

The moisture content of the flakes as produced by the roll press of the preferred embodiment, is of an approximate range of 7.5 to 9.0% by weight, while the coal tar content from the binder is about 3.6% by weight, dry basis. The crushing strength of these flakes ranges from 9 pounds to 14 pounds as tested by top pressing a ½-inch diameter steel ball down onto the center of a 1"×1" flake face of ¼" thickness. This crushing strength appears adequate to retain physical integrity of the flake during normal handling.

The flakes are then mixed with unagglomerated coal. In the preferred embodiment this is accomplished by slow-speed tumbling in a manner well known to the art. Up to 50% flakes by weight have been used to constitute the blend being charged into a coke oven without adverse effect on the oven walls. Below is an indication of test results on oven wall pressure, using the blend of the preferred embodiment.

Table VI

Oven Wall Pressures

85% Illinois No. 6 Seam + 15% Pocahantas No. 3 Seam

| Flakes in Charge, % | 0 | 30 | 40 |
|---|---|---|---|
| Bulk Density of Charge, lbs./cu.ft. | 53.0 | 53.3 | 54.2 |
| Maximum Wall Pressure,lbs./sq.in | 1.58 | 1.35 | 1.63 |

As will be noted from the test results shown in Table VI, the oven wall pressure decreases when 30% flakes were added, relative to the pressures experienced with no flakes included. When 40% flakes were added, the oven wall pressures did not significantly increase beyond the pressure experienced with no flakes included. In other tests, flake contents up to 50%, likewise, did not significantly increase the oven wall pressure to beyond the pressure experienced with no flakes included. These results are contrary to the expected increase of oven wall pressure exemplified by Table II.

The coke produced from the tests set forth in Table VI was tested for physical integrity, using tests well known and widely used by those skilled in the art. The results of those test are as follows:

Table VII

Integrity Tests

85% Illinois No. 6 Seam + 15% Pocahontas No. 3 Seam

| Flakes in Charge, % | 0 | 30 | 40 |
|---|---|---|---|
| Coke Size: | | | |
| % on 4" | 0.4 | 0.0 | 0.0 |
| % 4" × 3" | 18.0 | 16.7 | 12.6 |
| % 3" × 2" | 44.8 | 44.9 | 44.6 |
| Total on 2" | 64.1 | 61.6 | 57.2 |
| % 2" × 1½" | 25.3 | 25.1 | 28.6 |
| % 1½" × 1" | 5.9 | 7.3 | 7.4 |
| % 1" × ½" | 1.7 | 2.4 | 3.2 |
| % ½" | 3.0 | 3.6 | 3.6 |
| Coke Shatter Test: | | | |
| % on 3" | 4.6 | 7.6 | 0.0 |
| % on 3" × 2" | 42.2 | 40.4 | 41.0 |
| Total on 2" | 46.8 | 48.0 | 41.0 |
| % 2" × 1½" | 31.2 | 28.8 | 37.2 |
| % 1½" × 1" | 13.8 | 15.2 | 12.4 |
| % 1" × ½" | 3.8 | 4.6 | 4.6 |
| % ½" | 4.4 | 3.4 | 4.8 |
| Coke Tumbler Test: | | | |
| Stability Factor | 45.9 | 47.7 | 48.1 |
| Hardness Factor | 69.4 | 66.7 | 68.4 |
| Apparent Specific Gravity | 0.810 | 0.799 | 0.855 |

As noted, the coke produced from those blends containing flakes shows a degree of improvement in the stability of the coke produced over that exhibited by the blend with no flakes included.

Although the preferred embodiment has been described with a certain degree of particularity as required by the patent statutes, it is to be understood that the scope of the invention is not restricted whereby but is, rather, defined by the scope of the claims that follow.

What is claimed is:

1. A method of utilizing blends of marginal coking quality coals in coking operations to produce acceptable quality coke therefrom without increasing coke oven wall pressure beyond acceptable limits, comprising:

(a) blending low to medium volatile content coal with high volatile content coal both of marginal coking quality, to form a coal blend, said blend being composed of a range of 10% to 40% low to medium volatile content coal blended with a range of 90% to 60% high volatile content coal, by weight;

(b) combining a portion of said coal blend with a coal-tar based emulsion binder in such manner that said portion of said coal blend is throughly wetted by said binder, to form a combination thereof;

(c) compacting said combination of said portion of said coal blend and said binder in a roll press, utilizing smooth rolls, at a pressure sufficient to produce flakes;

(d) adding said flakes to the other portion of said coal blend in a sufficient amount that said flakes range between about 1% and 50% by weight of the mixture thereby resulting;

(e) charging a horizontal coke oven with said mixture thereby resulting; and (f) coking said mixture resulting therefrom, in a conventional coke oven.

2. The invention described in claim 1 wherein said flakes range from ½ to 4 inches in length by ½ to 4 inches in width by 1/16 to ½ inch in thickness.

3. The invention described in claim 1 further comprising gravity feeding said combination of said portion of said coal blend and said binder to said roll press for compacting.

4. The invention described in claim 1 wherein said roll press utilizes rolls, of about a 40-inch diameter, rotating at about nine revolutions per minute for compacting.

5. The invention described in claim 1 wherein said combining of said portions of said coal blend and said coal-tar based emulsion binder comprises:

(a) heating said portion of said coal blend to a range of 150°–180° F. with steam;

(b) heating said binder to a range of 150°–180° F.;

(c) agitating said heated portion of said coal blend;

(d) spraying said heated binder onto said heated portion of said coal blend as said heated portion of said coal blend is being agitated;

(e) halting said spraying while continuing said agitation for a time period sufficient to thoroughly wet said heated portion of said coal blend with said binder; and (f) drying said combination of said portion of said coal blend and said binder to a range of 4% to 12% water content, by weight.

6. The invention described on claim 5 wherein said roll press utilizes rolls of about a 40-inch diameter, rotating at about nine revolutions per minute for compacting.

7. The invention described in claim 6 wherein said flakes range from ½ to 4 inches in length by ½ to 4 inches in width by 1/16 to ½ inch in thickness.

8. The invention described in claim 7 further comprising gravity feeding said combination of said portions of said coal blend and said binder to said roll press for compacting.

9. The invention described in claim 1 wherein said coal-tar based emulsion binder has a composition, by weight, of about 42% water, 12% ammonium lignosulfonate (5% aqueous solution), 12% polyvinyl alcohol (5% aqueous solution), and 34% coal-tar.

10. The invention described in claim 1 wherein said coal blend has a size of 0 to 6% on a ¼" screen, 10 to 24% on a ¼"×6 mesh screen and 70 to 90% passing through a 6 mesh screen.

* * * * *